US011181014B2

(12) United States Patent
Kamo et al.

(10) Patent No.: US 11,181,014 B2
(45) Date of Patent: Nov. 23, 2021

(54) CLADDING ALLOY POWDER AND ASSEMBLY INCLUDING THE SAME

(71) Applicant: TOYOTA JIDOSHA KABUSHIKI KAISHA, Toyota (JP)

(72) Inventors: Yuki Kamo, Okazaki (JP); Kimihiko Ando, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 96 days.

(21) Appl. No.: 16/352,204

(22) Filed: Mar. 13, 2019

(65) Prior Publication Data

US 2019/0301314 A1 Oct. 3, 2019

(30) Foreign Application Priority Data

Mar. 30, 2018 (JP) ..... JP2018-067573

(51) Int. Cl.
*F01L 3/04* (2006.01)
*C22C 19/07* (2006.01)

(52) U.S. Cl.
CPC ..... *F01L 3/04* (2013.01); *C22C 19/07* (2013.01)

(58) Field of Classification Search
CPC ..... F01L 3/04; C22C 19/07
USPC ..... 123/188.3; 420/440
See application file for complete search history.

(56) References Cited

U.S. PATENT DOCUMENTS 4,787,736 A * 11/1988 Mori ..... B05B 7/228 251/368
5,242,758 A * 9/1993 Hitchcock ..... C22C 1/0433 420/436
2005/0069654 A1* 3/2005 Ellis ..... C23C 30/00 427/569
2007/0057238 A1* 3/2007 Matsuki ..... C22C 9/06 252/514
2017/0233852 A1* 8/2017 Yao ..... C23C 4/06 428/680

(Continued)

FOREIGN PATENT DOCUMENTS

CN 1038609 A 1/1990
JP S49-122817 A 11/1974
JP 61012843 A * 1/1986

(Continued)

OTHER PUBLICATIONS

Machine Translation of Detailed Description of JP-61012843-A provided by ESPACENET (Year: 2020).*

(Continued)

*Primary Examiner* — Michael A Kessler
(74) *Attorney, Agent, or Firm* — Oliff PLC

(57) ABSTRACT

Provided is cladding alloy powder that can keep enough corrosion resistance of the cladding portion on the engine valve and can suppress adherence of the cladding portion to the valve seat. Cladding alloy powder is to form a cladding portion at an engine valve that comes in contact with a valve seat of an engine. The cladding alloy powder includes 22 to 27 mass % of Cr; 10 to 30 mass % of Mo; 2.0 to 6.0 mass % of W; 0.40 to 1.30 mass % of C; 3.0 mass % or less of Si; 15.0 mass % or less of Ni; 30.0 mass % or less of Fe; and 0.4 mass % or less of S as well as Co and unavoidable impurity as a remainder, and satisfies $Cr(-0.53C+1.2)+Mo(-1.2C+2.8)\geq 24$ and $23W+2.7Mo\geq 73$.

2 Claims, 6 Drawing Sheets

(56) References Cited

U.S. PATENT DOCUMENTS

| | | | | |
|---|---|---|---|---|
| 2018/0066342 | A1 | 3/2018 | Kamo et al. | |
| 2018/0272451 | A1* | 9/2018 | Perez | C22C 30/00 |

FOREIGN PATENT DOCUMENTS

| | | | | |
|---|---|---|---|---|
| JP | 62033090 | A | * | 2/1987 |
| JP | H05-84592 | A | | 4/1993 |
| JP | 2018-39037 | A | | 3/2018 |

OTHER PUBLICATIONS

Abstract with Constitution of JP-61012843-A from EAST (Year: 1984).*

Zirconium in the Nuclear Industry: Twelfth International Symposium. G.Sabol and G. Moan (2000, Philadelphia) p. 759 (Zirconium in the Nuclear Industry: Twelfth International Symposium) (Year: 2000).*

H.Xie et al.Quantification of trace amounts of impurities in high purity cobalt by high resolution inductively coupled plasma mass spectrometry. Rare Metals vol. 26, Issue 3, Jun. 2007, pp. 286-291 (Year: 2007).*

* cited by examiner

CLADDING ALLOY POWDER AND ASSEMBLY INCLUDING THE SAME

CROSS REFERENCE TO RELATED APPLICATIONS

The present application claims priority from Japanese patent application JP 2018-067573 filed on Mar. 30, 2018, the content of which is hereby incorporated by reference into this application.

BACKGROUND

Technical Field

The present disclosure relates to alloy powder for cladding (hereinafter called cladding alloy powder) to form a cladding portion at an engine valve in a position to come in contact with a valve seat of the engine, and relates to an assembly of the engine valve cladded with this alloy powder and the valve seat.

Background Art

To form a cladding portion at an engine valve in a position to come in contact with a valve seat of the engine, alloy powder is deposited for cladding on the face of the engine valve, for example.

JP H05-84592 A, for example, discloses cladding alloy containing in the weight ratio: 10 to 40% of Cr; exceeding 10 to 30% of Mo; 1 to 20% of W; 0.5 to 5% of Si; 0.05 to 3% of C; 0.001 to 0.12% of Al; 0.001 to 0.1% of 0; 30% or less of Fe; 20% or less of Ni; and 3% or less of Mn, and containing Co and unavoidable impurity elements as a remainder (the amount of Co is 30 to 70 weight %).

SUMMARY

Such cladding alloy powder described in JP H05-84592 A deposited as a cladding portion on the valve face, however, may adhere to the valve seat as a member abutting against it and they may be worn. Additionally this cladding portion does not have enough corrosion resistance. As the corrosion is advanced at the cladding portion, this makes the cladding portion coarse on the surface and so abrasive wear may be accelerated between the cladding portion and the valve seat. Especially when fuel for the engine includes ethanol, ethanol-blended gasoline, CNG or LPG, for example, the cladding portion will be exposed to more corrosive environment, and so the abrasive wear between the cladding portion and the valve seat may be more prominent.

In view of these problems, the present disclosure provides cladding alloy powder that can keep enough corrosion resistance of the cladding portion on the engine valve and can suppress adherence of the cladding portion to the valve seat. The present disclosure also provides an assembly of the engine valve with this cladding alloy powder deposited and the valve seat.

To solve these problems, cladding alloy powder according to the present disclosure is to form a cladding portion at an engine valve that comes in contact with a valve seat of an engine, and the cladding alloy powder includes: 22 to 27 mass % of Cr; 10 to 30 mass % of Mo; 2.0 to 6.0 mass % of W; 0.40 to 1.30 mass % of C; 3.0 mass % or less of Si; 15.0 mass % or less of Ni; 30.0 mass % or less of Fe; and 0.4 mass % or less of S as well as Co and unavoidable impurity as a remainder, and the cladding alloy powder satisfies the following Expressions (1) and (2):

$$Cr(-0.53C+1.2)+Mo(-1.2C+2.8)\geq 24 \quad (1); \text{ and}$$

$$23W+2.7Mo\geq 73 \quad (2),$$

where chemical symbols shown in the Expressions (1) and (2) represent amounts of the corresponding elements in the mass %.

The cladding alloy powder of the present disclosure is alloy powder containing cobalt (Co) as a base that is the basic component, and assuming that the overall amount is 100 mass %, the cladding alloy powder contains the above-stated components in the above-stated range.

Assuming the above range of the amounts, the present disclosure satisfies the above Expressions (1) and (2). Expression (1) is an index for corrosion resistance of the cladding portion deposited and made of the cladding alloy powder as described later by way of Examples, for example, and satisfaction of this relationship can lead to the improvement of the corrosion resistance of the cladding portion. Expression (2) is an index for adhesion resistance of the cladding portion deposited and made of the cladding alloy powder as described later by way of Examples, for example, and satisfaction of this relationship can suppress adhesion of the member (valve seat) abutting against the cladding portion.

As a result, cladding alloy powder according to the present disclosure, which is to form a cladding portion at an engine valve, can keep enough corrosion resistance of the cladding portion and can suppress adherence of the cladding portion to the valve seat.

Such cladding alloy powder can be used to form an assembly that includes the engine valve having the cladding alloy powder deposited at a part to come in contact with the valve seat in combination with the valve seat.

DETAILED DESCRIPTION

Figure 1:
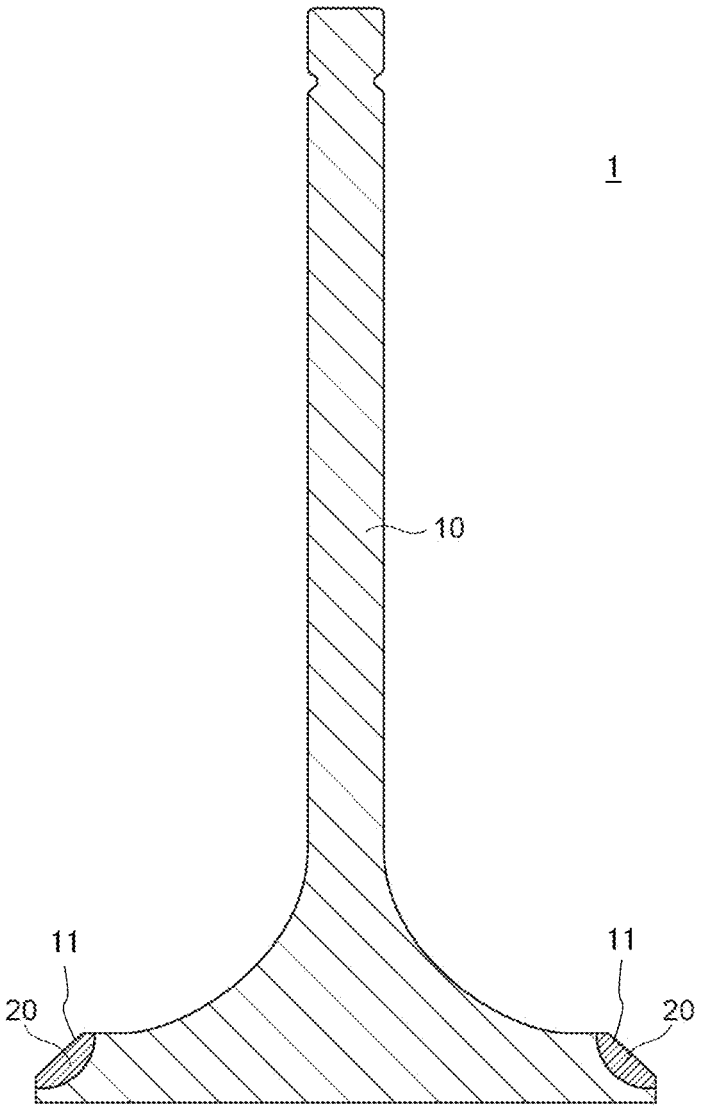
FIG. 1 is a schematic cross-sectional view of an engine valve having a cladding portion that is formed with cladding alloy powder of the present embodiment.

Referring to FIG. 1, the following describes one embodiment of the present disclosure. FIG. 1 is a schematic cross-sectional view of an engine valve 1 having a cladding portion 20 that is formed with cladding alloy powder of the present embodiment.

1. Cladding Alloy Powder

Cladding alloy powder of the present embodiment is deposited annually on a valve body 10 of the engine valve 1 made of a metal material described later so as to form a cladding portion 20. When this engine valve 1 is mounted to a cylinder head, the surface of the cladding portion 20 defines a valve face 11 to come in contact with a valve seat 30, and the valve seat 30 repeatedly abuts against this surface (see FIG. 3, for example).

Cladding alloy powder according to the present embodiment contains: 22 to 27 mass % of Cr; 10 to 30 mass % of Mo; 2.0 to 6.0 mass % of W; 0.40 to 1.30 mass % of C; 3.0 mass % or less of Si; 15.0 mass % or less of Ni; 30.0 mass % or less of Fe; and 0.4 mass % or less of S as well as Co and unavoidable impurity as a remainder. Note here that the cladding alloy powder of the present embodiment may include the above-specified elements only, or may additionally contain Mn only to these specified elements as needed. Cladding alloy powder is an aggregation of alloy particles for cladding, and contains elements (composition) described later for the alloy particles for cladding.

These particles can be manufactured by preparing molten metal containing the above-stated composition blended in the above-stated ratio and then by performing atomizing to spray this molten metal. In another method, the molten metal may be solidified to be a solid, and then the solid may be mechanically pulverized to be powder. The atomizing may be gas atomizing or water atomizing. The following describes the grounds for selecting the elements of the cladding alloy powder and for their numerical ranges in details.

<Cr (chromium): 22 to 27 mass %>

Cr forms a Cr oxide film (passive oxide film) on the surface of a Co matrix of the cladding portion 20 so as to exert corrosion resistance of the engine valve 1. This Cr oxide film prevents adherence between the cladding portion 20 and the valve seat 30. If Cr is less than 22 mass %, the Cr oxide film cannot be formed stably on the surface of the Co matrix, and so corrosion resistance cannot be obtained. The present embodiment therefore specifies the lower limit of Cr as 22 mass %. If Cr exceeds 27 mass %, then the quality of the cladding portion made of such cladding alloy powder deteriorates, and the toughness of the cladding portion 20 also deteriorates. The present embodiment therefore specifies the upper limit of Cr as 27 mass %. Note here that "the quality of cladding portion" in this specification refers to the wettability of the deposited cladding portion to the valve body 10 and the shape stability of the cladding portion in the molten state. Deterioration of the quality of cladding portion means that the deposited cladding portion 20 fails to keep a desired shape (more specifically a shape of a bead).

<Mo (Molybdenum): 10 to 30 Mass %>

Mo forms a solid solution in the Co matrix of the cladding portion 20 to promote the formation of the Cr oxide film. If the Cr oxide film breaks, Mo promotes the regeneration of the Cr oxide film. This can keep the corrosion resistance of the cladding portion 20, and can suppress adhesion to the valve seat 30 as the member abutting against it. If Mo is less than 10 mass %, the Cr oxide film cannot be formed stably on the surface of the cladding portion 20, and this causes deterioration in corrosion resistance of the cladding portion 20. The present embodiment therefore specifies the lower limit of Mo as 10 mass %. If Mo exceeds 30 mass %, then the quality of the cladding portion deteriorates, and the toughness of the cladding portion 20 also deteriorates. The present embodiment therefore specifies the upper limit of Mo as 30 mass %.

<W (Tungsten): 2.0 to 6.0 Mass %>

W contributes to improve the adhesion resistance of the cladding portion 20. If W is less than 2.0 mass %, the amount of tungsten carbide in the cladding portion 20 is not enough. This fails to keep enough hardness of the base of the Cr oxide coating. Such a Cr oxide coating therefore may break easily. This results in adherence of metal parts of the cladding portion 20 and the valve seat 30, and advances the wear between them. The present embodiment therefore specifies the lower limit of W as 2.0 mass %. If W exceeds 6.0 mass %, then the quality of the cladding portion made of such cladding alloy powder deteriorates, and the toughness of the cladding portion 20 also deteriorates. The present embodiment therefore specifies the upper limit of W as 6.0 mass %.

<C (Carbon): 0.40 to 1.30 Mass %>

C forms carbide in the cladding portion 20 to improve the strength and wear resistance of the cladding portion 20. If C is less than 0.4 mass %, a hard carbide phase will not be formed in the cladding portion 20, and so sufficient hardness of the base for the Cr oxide coating cannot be obtained. The resultant cladding portion 20 therefore will be easily worn. Additionally such insufficient hardness of the base causes easy break of the Cr oxide coating when the valve seat 30 comes in contact with the Cr oxide coating. This results in adherence of metal parts of the cladding portion 20 and the valve seat 30, and so advances the wear of the valve seat 30. The present embodiment therefore specifies the lower limit of C as 0.40 mass %. If C exceeds 1.30 mass %, the carbide phase will be formed too much. This decreases solid solutions of Cr and Mo in the Co matrix, and so an enough Cr oxide film cannot be formed. As a result the corrosion resistance of the cladding portion 20 deteriorates. As a result the cladding portion 20 becomes coarse on the surface, and so the attackability of the cladding portion against the valve seat increases. The present embodiment therefore specifies the upper limit of C as 1.30 mass %.

<Si (Silicon): 3.0 Mass % or Less>

Si can improve the quality of the cladding portion. If Si exceeds 3.0 mass %, then the quality of the cladding portion made of such cladding alloy powder deteriorates, and the toughness of the cladding portion 20 also deteriorates. The attackability of the cladding portion 20 against the valve seat 30 also increases. The present embodiment therefore specifies the upper limit of Si as 3.0 mass %.

<Ni (Nickel): 15 Mass % or Less>

Ni contributes to improve the toughness and corrosion resistance of the cladding portion 20. If Ni exceeds 15 mass %, then the quality of the cladding portion made of such cladding alloy powder deteriorates, and the wear resistance of the cladding portion 20 also deteriorates. The present embodiment therefore specifies the upper limit of Ni as 15 mass %.

<Fe (Iron): 30 Mass % or Less>

Fe contributes to improve the toughness of the cladding portion 20. If Fe exceeds 30 mass %, then the corrosion resistance of the cladding portion deteriorates. The present embodiment therefore specifies the upper limit of Fe as 30 mass %.

<S (Sulfur): 0.4 Mass % or Less>

S contributes to improve the quality of the cladding portion and can promote discharging of blowholes. If S exceeds 0.4 mass %, then solidification cracking occurs. The present embodiment therefore specifies the upper limit of S as 0.4 mass %.

<Mn (Manganese): 3.0 Mass % or Less>

Mn contributes to improve the quality of the cladding portion and is added as needed. If Mn exceeds 3.0 mass %, then the wear resistance of the cladding portion deteriorates. The present embodiment therefore specifies the upper limit of Mn as 3.0 mass %.

<Co (Cobalt): Remainder>

Co is the matrix of the cladding alloy powder, and is included in the cladding alloy powder as the remainder assuming that the cladding alloy powder contains the above-stated composition. The remainder may contain unavoidable impurity.

In addition to the amounts of the elements of the cladding alloy powder being within the above-stated range, the cladding alloy powder of the present embodiment satisfies the following relationships of Expression (1) and Expression (2):

$$Cr(-0.53C+1.2)+Mo(-1.2C+2.8)\geq 24 \quad (1); \text{ and}$$

$$23W+2.7Mo\geq 73 \quad (2),$$

where chemical symbols shown in the Expressions (1) and (2) represent amounts of the corresponding elements in the mass %.

As described in Examples described later, Expression (1) is an index indicating the corrosion resistance of the cladding portion 20 deposited and made of the cladding alloy powder. The left side of Expression (1) is defined to represent the ability to form a Cr oxide film that contributes to the corrosion resistance. A larger value of this means higher corrosion resistance. In the present embodiment, satisfaction of the relationship of Expression (1) can lead to the improvement of the corrosion resistance of the cladding portion 20.

As described in Examples described later, Expression (2) is an index indicating the adhesion resistance between the cladding portion 20 deposited and made of the cladding alloy powder and the valve seat 30. The left side of Expression (2) is defined while focusing on Mo that contributes to the regeneration of the Cr oxide film and W that contributes to hardening of the carbide phase. A larger value of this means less adhesion between the cladding portion 20 and valve seat 30. In the present embodiment, satisfaction of the relationship of Expression (2) can suppress adhesion of the valve seat 30 to the cladding portion 20, which results from breakage of the Cr oxide film.

According to the present embodiment, the amounts of the components of the cladding alloy powder are within the above-stated specific range, and the amounts satisfy the relationships of Expressions (1) and (2), whereby the cladding portion 20 can keep high corrosion resistance, and adhesion of the valve seat 30 to the cladding portion 20 can be reduced.

2. Engine Valve 1

Figure 3:
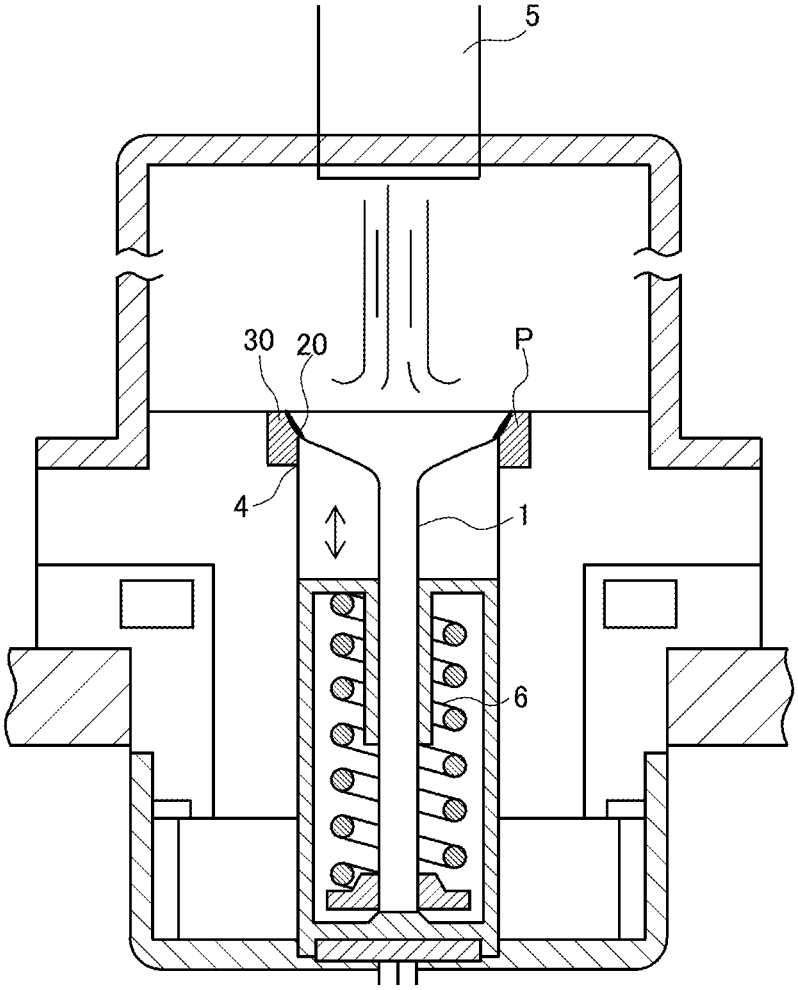
FIG. 3 schematically shows the concept of a wear tester for single-body wear test.

As shown in FIGS. 1 and 3, the valve body 10 of the engine valve 1 of the present embodiment has the cladding portion 20, and the surface of the cladding portion 20 defines a valve face 11 that comes in contact with the valve seat 30. The cladding portion 20 is prepared by melting cladding alloy powder and depositing the molten cladding alloy powder (cladding material) by plasma cladding, for example.

The device shown in FIG. 3 is a wear tester used for a single-body wear test described later. As described later, the positional relationship between the engine valve 1 and the valve seat 30 and the behavior of the engine valve 1 are the same as those in the actual device.

The valve body 10 of the engine valve 1 of the present embodiment may be made of a metal material, such as cast iron or steel, and exemplary materials include austenitic heat resisting steels (Japanese Industrial Standards (JIS): SUH35, SUH36, SUH660, NCF750, NCF751, NCF800) and martensite heat resisting steels (JIS: SUH1, SUH4, SUH11).

Assuming that the valve body 10 as a whole is 100 mass %, the amount of Cr in the valve body may be 16 mass % or more, or may be 18 mass % or more. If the amount of Cr is less than 16 mass %, Cr of the cladding portion 20 forms solid solutions or is dispersed in the valve body 10 during the formation of the cladding portion 20, and so the amount of Cr in the cladding portion 20 decreases. This decreases the amount of Cr as solid solutions in the Co matrix of the cladding portion 20, and so a Cr oxide film may not be formed stably on the surface of the cladding portion 20.

Examples of the material of the valve seat 30 include Fe-based alloy and Cu-based alloy. When it includes Fe-based alloy, the valve seat 30 may be made up of a sintered body. When it includes Cu-based alloy, the valve seat 30 may be made up of a cladding member formed by cladding.

In this way, an assembly can be obtained, which includes the engine valve 10 having the cladding portion by depositing the above-stated cladding alloy powder at a part to come in contact with the valve seat 30 (i.e., the valve face 11) in combination with the valve seat 30. For an engine including such an engine valve 1, any one type of the fuel including gasoline, ethanol, ethanol-blended gasoline, CNG (compressed natural gas), or LPG (liquefied petroleum gas) may be used for the engine.

When ethanol or ethanol-blended gasoline is used for the fuel, this will lead to more corrosive environment than gasoline. The cladding portion 20 formed at the engine valve 1 using the cladding alloy powder according to the present embodiment can keep the corrosion resistance of the cladding portion 20 in such a tough environment as well, and can suppress adhesion to the valve seat 30. As a result the engine can have improved durability.

EXAMPLES

The following describes the present disclosure more specifically by way of Examples and Comparative Examples.

1. Determining the Expression to Calculate a Corrosion-Resistance Value

An engine valve may be exposed to a corrosive environment during combustion of the fuel. Especially alcohol-containing fuel generates acid (e.g., formic acid) having both of acidic and reducing properties more than in gasoline fuel. The cladding portion of the engine valve comes in contact with the valve seat. If such a cladding portion corrodes, abrasive wear may occur between these parts.

More specifically, if a Cr oxide film is not sufficiently formed on the surface of the Co matrix of the cladding portion, the base material of the cladding portion will be exposed to corrosive environment. The Co matrix of the base material galvanic-corrodes due to the carbide phase. This corrosion raises the carbide phase from the surface of the cladding portion, and so makes the surface of the cladding portion coarse. When such a surface comes in contact with the valve seat repeatedly, the rough surface of the cladding portion shaves the valve seat, which advances abrasive wear between them.

To increase the corrosion resistance of the cladding portion, it is therefore important to form a Cr oxide film uniformly on the surface of the cladding portion and so suppress galvanic corrosion. During the formation of a Cr oxide film on the surface of the Co matrix, Mo, which forms solid solutions in the Co matrix, aids the formation.

Addition of Cr and Mo, however, may accelerate galvanic corrosion due to carbide, such as chromium carbide or molybdenum carbide, and also reduces the amount of Cr and Mo that contribute to the formation of the Cr oxide film. The present inventors then focused on not only Cr and Mo but also C. Using the materials shown in the following Reference Examples 1-1 to 1-8, the present inventors confirmed the relationship between the amounts of these elements and the corrosion depth.

Reference Example 1-1

As shown in Table 1, alloy (ingot) having the composition containing 22.9 mass % of Cr, 13.2 mass % of Mo, 0.9 mass % of C and Co and unavoidable impurity as the remainder was prepared. This ingot was molten at a temperature of 1500° C. or higher, and cladding alloy powder was prepared by gas atomizing using inert gas. The resultant cladding alloy powder was then sorted to be in the range of 44 to 250 μm. In this way, the cladding alloy powder of Reference Example 1-1 was obtained.

Next, the obtained cladding alloy powder was heated to the temperature of 1500° C. by plasma welding under the conditions of the output of 130 A and the processing speed of 8 mm/sec to melt the powder. The molten cladding alloy powder (cladding material) was then deposited on the valve face of the valve body. In this way a specimen of the engine valve having the cladding portion on the valve face of the valve body was obtained. The body of the engine valve was made of austenitic heat resisting steels (the amount of Cr was 13 mass %).

Reference Example 1-2 to 1-8

Similarly to Reference Example 1-1, specimens of the engine valves of Reference Examples 1-2 to 1-8 were prepared. These Reference Examples 1-2 to 1-8 were different from Reference Example 1-1 in the chemical components of the cladding alloy powder shown in Table 1. The specimens of Reference Examples 1-1 to 1-8 had a fixed amount of C and varied amounts of Cr and Mo.

<Immersion Test>

The specimens of Reference Examples 1-1 to 1-8 were immersed in hydrochloric acid solution with the pH of 0.6 for 24 hours. Next each of the specimens after immersion was cut, and the cross section of the cladding portion was observed with a microscope to measure the depth of corrosion on the microscopic image. Table 1 shows the result.

<Test to Measure the Amount of Solid Solution>

The amount of solid solutions from the cladding portion of the specimens of Reference Examples 1-1 to 1-8 to the valve body was measured with an X-ray analyzer. More specifically the amounts of C, Cr and Mo included in the valve body in the vicinity of the cladding portion were measured as the amount of solid solutions. Table 1 shows the result.

TABLE 1

| | Chemical components of cladding alloy powder (mass %) | | | | Amount of solid solutions to valve body (mass %) | | | Corrosion | Corrosion resistance value |
|---|---|---|---|---|---|---|---|---|---|
| | C | Cr | Mo | Co | C | Cr | Mo | depth [μm] | (Expression 1) |
| Reference Ex. 1-1 | 0.9 | 22.9 | 13.2 | Remainder | 0.9 | 16.6 | 6.6 | 1.05 | 39.3 |
| Reference Ex. 1-2 | 0.9 | 24.3 | 12.4 | Remainder | 0.9 | 17.6 | 6.2 | 1.4 | 38.9 |
| Reference Ex. 1-3 | 0.9 | 22.7 | 11.9 | Remainder | 0.9 | 16.4 | 5.9 | 2.05 | 36.9 |
| Reference Ex. 1-4 | 0.9 | 22.0 | 10.0 | Remainder | 0.9 | 15.9 | 5.0 | 4.25 | 33.1 |
| Reference Ex. 1-5 | 0.9 | 22.0 | 5.0 | Remainder | 0.9 | 15.9 | 2.5 | 12.5 | 24.5 |
| Reference Ex. 1-6 | 0.9 | 21.0 | 10.0 | Remainder | 0.9 | 15.2 | 5.0 | 12.5 | 32.4 |
| Reference Ex. 1-7 | 0.9 | 30.0 | 5.0 | Remainder | 0.9 | 21.7 | 2.5 | 10 | 30.3 |
| Reference Ex. 1-8 | 0.9 | 20.0 | 6.0 | Remainder | 0.9 | 14.5 | 3.0 | 15 | 24.8 |

(Result 1)

Based on the amounts of the chemical components of the cladding alloy powder shown in Table 1 and the depths of corrosion, the following Expression (1A) was obtained by multi-regression analysis, where the amounts of C, Cr and Mo were variables and the depth of corrosion was the corrosion-resistance value calculated from these variables.

$$\text{Corrosion-resistance value}=Cr(-0.53C+1.2)+Mo(-1.2C+2.8) \quad (1A).$$

The chemical symbols shown in this Expression (1A) represent the amounts of the corresponding elements in the mass %.

Figure 2:
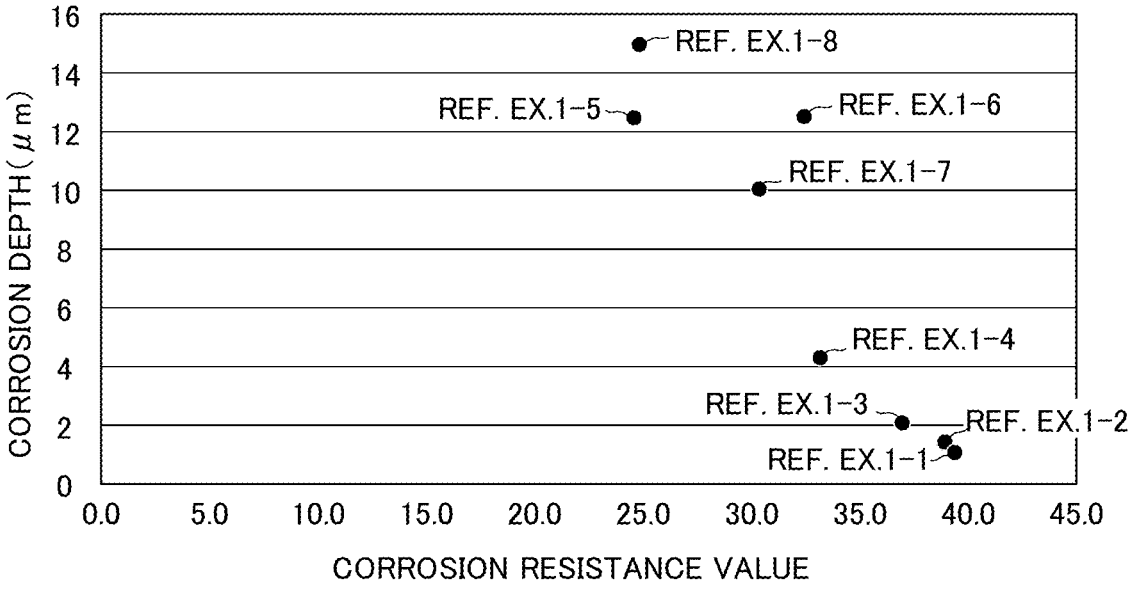
FIG. 2 is a graph showing the relationship between the corrosion-resistance values of Reference Examples 1-1 to 1-8 and their depth of corrosion.

Table 1 shows the corrosion-resistance values of Reference Examples 1-1 to 1-8 calculated by Expression (1A). FIG. 2 is a graph showing the relationship between the corrosion-resistance values of Reference Examples 1-1 to 1-8 calculated by Expression (1A) and their depth of corrosion. As shown in FIG. 2, a large corrosion-resistance value calculated by Expression (1A) means a smaller depth of corrosion, which shows that the corrosion-resistance values and the depths of corrosion correlate highly with each other.

Note here that Expression (1A) is defined to means that a part of Cr and Mo, which are added to form a Cr oxide film, is consumed to form a carbide phase. Accordingly a lower amount of C, for example, means a larger corrosion-resistance value in Expression (1A), which means that a Cr oxide film can be easily formed on the surface of the cladding portion and the cladding portion has high corrosion resistance.

In the present embodiment as stated above, the amount of Cr in the cladding alloy powder is 22 to 27 mass %. In Reference Examples 1-4 and 1-5, the amount of Cr in the cladding alloy powder was 22 mass %, and the amount of solid solutions of Cr in the valve body was 15.9 mass %. This means that 16 mass % or more of Cr in the valve body can suppress solid solutions and dispersion of Cr from the cladding portion to the valve body and so can keep a sufficient amount of Cr in the cladding portion.

2. Determining the Expression to Calculate an Adhesion-Resistance Value

The valve seat that comes in contact with the engine valve during operation generates adhesion and wear. This adhesion and wear occurs as follows. The Co matrix including solid solutions of Cr and Mo of the cladding portion adheres to the valve seat, which plucks the valve seat, and so the valve seat is worn. To reduce such adhesion and wear, it is important to continuously form a Cr oxide film on the surface of the cladding portion including the Co matrix during the operation.

To this end, the base of the Cr oxide film is desirably a base that can suppress breakage of Cr. Even if the Cr oxide film physically breaks, there is desirably a function of regenerating the Cr oxide film. The present inventors focused on W for the base that can suppress breakage of the Cr oxide film. Due to W, tungsten carbide is formed around the Co matrix, and this can increase the hardness of the base of the Cr oxide film. To promote the regeneration of the broken Cr oxide film, it is known that the amount of Mo that forms solid solutions in the Co matrix is dominant.

The present inventors then focused on the elements of Mo and W contained in the cladding alloy powder, and manufactured the specimens of the following Reference Examples 2-1 to 2-10, and confirmed the relationship between the amounts of these elements and the total amount of wear between the engine valve and the valve seat.

Reference Example 2-1 to 2-10

Similarly to Reference Example 1-1, specimens of the engine valves of Reference Examples 2-1 to 2-10 were prepared. These Reference Examples 2-1 to 2-10 were different from Reference Example 1-1 in the chemical components of the cladding alloy powder shown in Table 2.

<Single-Body Wear Test>

FIG. 3 schematically shows the concept of a wear tester for the single-body wear test. Using the tester shown in FIG. 3, single-body wear test was conducted to the engine valves (specimens) of Reference Example 2-1 to 2-10. Specifically copper alloy containing 17 mass % of Ni, 9 mass % of Fe, 7 mass % of Mo, 3 mass % of Si, 1 mass % of Nb, 0.1 mass % of C, and Cu and unavoidable impurity as the remainder was pulverized by gas atomizing to be copper alloy powder (the diameter of the powder was 44 to 250 m) as the Cu-based material, and this prepared powder was deposited on the cylinder head to make the valve seat 30. Next the sliding part between the cladding portion 20 deposited in this way and the valve seat 30 was placed in the propane-gas combustion atmosphere using a propane gas burner 5 as a heating source.

The temperature of the valve seat 30 was regulated at 200° C., and load of 18 kgf was applied by a spring 6 when the cladding portion 20 came in contact with the valve seat 30. The cladding portion 20 and the valve seat 30 were brought into contact with each other at the rate of 2000 times/min. to conduct the wear test for 8 hours. In this wear test, the depressed amount of the valve from the reference position P was measured. The depressed amount of the valve corresponds to the wear amount (wear depth) of the engine valve 1 and the valve seat 30 when they came into contact with each other and were worn by the contact. Table 2 shows the result. The wear amount shown in Table 2 is a total of the wear amount of the cladding portion and the wear amount of the valve seat.

TABLE 2

| | Chemical components of cladding alloy powder (mass %) | | | | | Wear amount | Adhesion-resistance value |
|---|---|---|---|---|---|---|---|
| | Cr | Mo | W | C | Co | [μm] | (Expression 2) |
| Reference Ex. 2-1 | 22 | 12 | 3.15 | 0.5 | Remainder | 88 | 104.85 |
| Reference Ex. 2-2 | 22 | 12 | 3.15 | 0.75 | Remainder | 89 | 104.85 |
| Reference Ex. 2-3 | 22 | 12 | 3.15 | 1 | Remainder | 90 | 104.85 |
| Reference Ex. 2-4 | 22 | 12 | 4.15 | 1 | Remainder | 51 | 127.85 |
| Reference Ex. 2-5 | 22 | 21 | 3.15 | 0.7 | Remainder | 45 | 129.15 |
| Reference Ex. 2-6 | 22 | 21 | 4.15 | 0.7 | Remainder | 37 | 152.15 |
| Reference Ex. 2-7 | 22 | 10 | 2.5 | 0.7 | Remainder | 108 | 84.5 |
| Reference Ex. 2-8 | 27 | 22 | 4.15 | 0.9 | Remainder | 53 | 154.85 |
| Reference Ex. 2-9 | 27 | 20 | 4.15 | 0.7 | Remainder | 33 | 149.45 |
| Reference Ex. 2-10 | 22 | 13 | 3.5 | 0.7 | Remainder | 70 | 115.6 |

(Result 2)

Based on the amount of the chemical components of the cladding alloy powder and the wear amounts shown in Table 2, the following Expression (2A) was obtained by multi-regression analysis, where the amounts of Mo and W in the cladding alloy powder were variables and the wear amount was the adhesion-resistance value calculated from these variables.

$$\text{Adhesion-resistance value}=23W+2.7Mo \quad (2A).$$

The chemical symbols shown in this Expression (2A) represent the amounts of the corresponding elements in the mass %.

Figure 4:
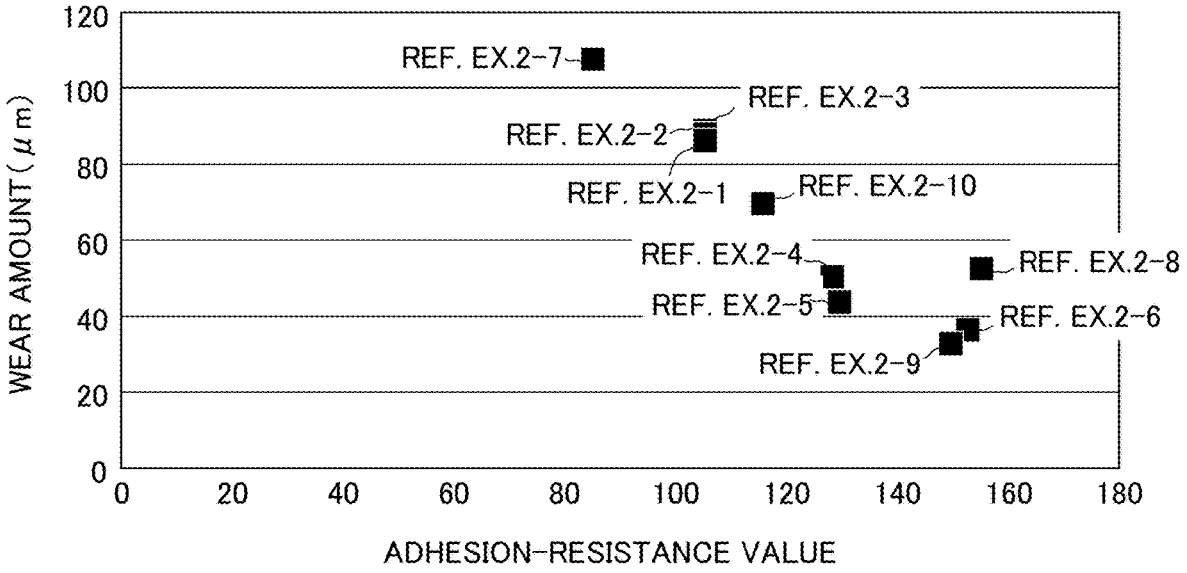
FIG. 4 is a graph showing the relationship between the adhesion-resistance values of Reference Examples 2-1 to 2-10 and their wear amounts.

Table 2 shows the adhesion-resistance values of Reference Examples 2-1 to 2-10 calculated by Expression (2A). FIG. 4 is a graph showing the relationship between the calculated adhesion-resistance values and the wear amounts. As shown in FIG. 4, the wear amount decreases with an increase in adhesion-resistance value, which shows that the adhesion-resistance values and the wear amounts correlate highly with each other.

Expression (2A) is defined to mean that the term of W corresponds to the hardness of the base of the Cr oxide film and the term of Mo corresponds the ability to regenerate the Cr oxide film. Expression (2A) therefore means that a larger amount of W, which means a harder base of the Cr oxide film, can suppress the breakage of the Cr oxide film, and a large amount of Mo, which means easy regeneration of the broken Cr oxide film, if any, can reduce adhesion and wear between the cladding portion and the valve seat.

3. Appropriate Range of Corrosion-Resistance Value and Adhesion-Resistance Value Appropriate range of corrosion-resistance value and adhesion-resistance value was confirmed from the following Examples 1-1 to 1-5 and Comparative Examples 1-1 to 1-3.

Example 1-1

For the cladding alloy powder of this example of the present disclosure, cobalt-based cladding alloy powder was prepared, which satisfied the condition of 22 to 27 mass % of Cr; 10 to 30 mass % of Mo; 2.0 to 6.0 mass % of W; 0.40 to 1.30 mass % of C; 3.0 mass % or less of Si; 15.0 mass % or less of Ni; 30.0 mass % or less of Fe; and 0.4 mass % or less of S as well as Co and unavoidable impurity as a remainder.

Specifically as shown in Table 3, the cladding alloy powder of Example 1-1 contained 22 mass % of Cr, 12 mass % of Mo, 2.0 mass % of W, 1.00 mass % of C, 6.0 mass % of Ni, 0.8 mass % of Si, 5.0 mass % of Fe, 0.4 mass % or less of S, 0.3 mass % of Mn and Co and unavoidable impurity as the remainder.

Next similarly to Reference Example 1-1, a cladding portion was deposited on the valve face of the engine valve using the obtained cladding alloy powder, and a specimen of the engine valve was prepared. A base having a flat face with the dimension of 20 mm×20 mm and with the height of 2 mm (made of the same material as that of the engine valve) also was prepared, and a cladding portion was deposited on the surface of the base under the same condition. A specimen for the wear test was prepared in this way.

Examples 1-2 to 1-5 and Comparative Examples 1-1 to 1-3

Similarly to Example 1-1, specimens including the cladding portions made of cladding alloy powder were prepared. These Examples 1-2 to 1-5 and Comparative Examples 1-1 to 1-3 were different in the chemical components of the cladding alloy powder shown in Table 3. Among the chemical components shown in Table 3, the amounts of Cr, Mo, W and C that contribute to corrosion resistance and adhesion resistance were changed, and the amounts of the other chemical components were constant.

<Calculation of Corrosion-Resistance Value and Adhesion-Resistance Value>

For Examples 1-1 to 1-5 and Comparative Examples 1-1 to 1-3, their corrosion-resistance values and adhesion-resistance values were calculated by Expressions (1A) and (2A) as stated above. Table 3 shows the result.

<Evaluation of Bead and Cracking>

For the specimens of the engine valves of Examples 1-1 to 1-5 and Comparative Examples 1-1 to 1-3, the shapes of the beads at the cladding portions were observed. All of the specimens showed favorable quality of the cladding portion, and no defectives were found for the shapes of their beads at the cladding portion, and no cracking was found at their cladding portions.

<Corrosion Test>

Figure 5A:
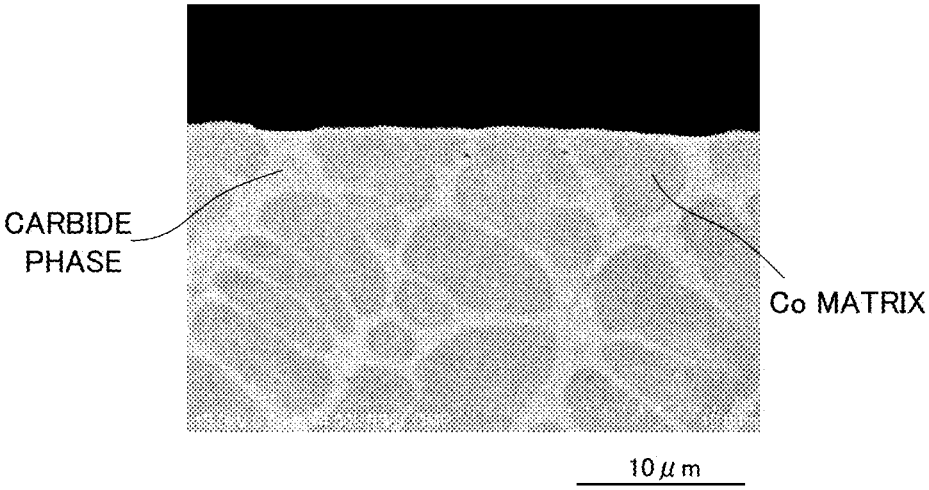
FIG. 5A is a photo of the specimen of Example 1-5 in cross section after the wear test.
Figure 5B:
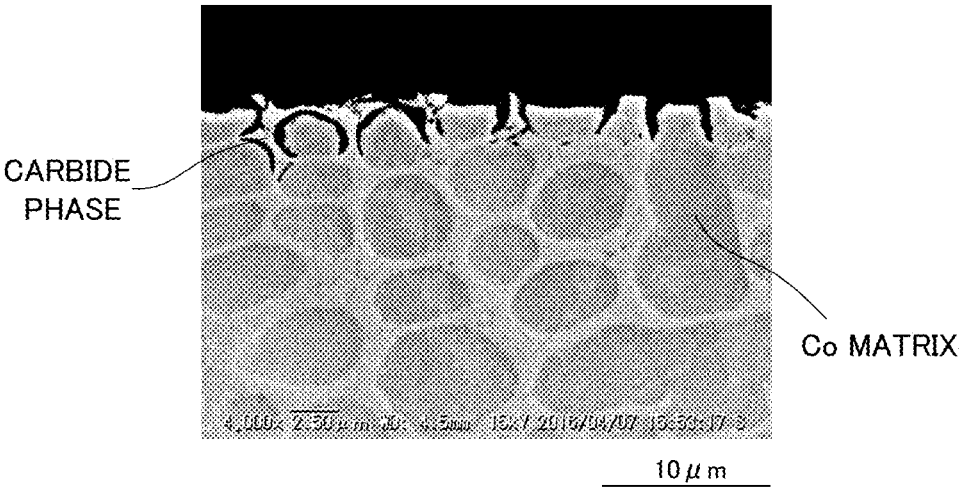
FIG. 5B is a photo of the specimen of Comparative Example 1-1 in cross section after the wear test.

The specimens of Examples 1-1 to 1-5 and Comparative Examples 1-1 to 1-3 for corrosion test were immersed in the corrosion solution with a pH of 1.5 at 70° C. for 24 hours. After immersion, each specimen was cut (at two places), and their cross sections were observed with a scanning microscope (SEM) (4000 magnification) to check whether they had corrosion or not on the outermost layer of the tested face. This checking about the presence or not corrosion was conducted by comparing with the mirror polished face not subjected to the immersion, and two cross sections were observed for one specimen. When the specimen did not have corrosion, it was evaluated as "good". When the specimen had corrosion, it was evaluated as "bad". Table 4 shows the result. FIGS. 5A and 5B show (SEM) photos of a part in the vicinity of the outermost layer in cross section of Example 1-5 and Comparative Example 1-1, respectively, after corrosion test among Examples and Comparative Examples observed about their structures.

<Single-Body Wear Test>

Figure 6A:
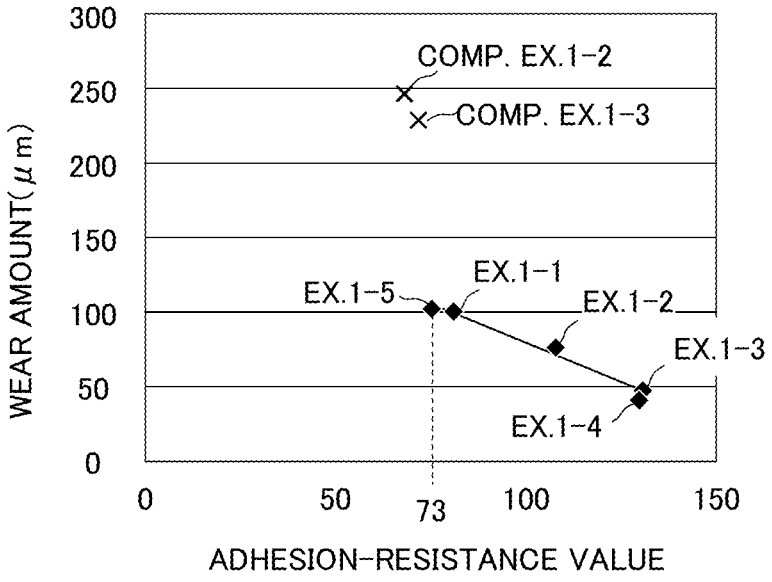
FIG. 6A is a graph showing the relationship between the adhesion-resistance values and the wear amounts after the single-body wear test for Examples 1-1 to 1-5 and Comparative Examples 1-2 and Example 1-3.

Single-body wear test as stated above was conducted to the specimens of the engine valves of Examples 1-1 to 1-5, Comparative Example 1-2 and Comparative Example 1-3. After the single-body wear test, the wear amount of the cladding portion of each engine valve and the wear amount of the valve seat were measured, and the sum of these amounts was calculated as the total wear amount. When the specimen had the wear amount that was 100 μm or less, it was evaluated as "good". When the wear amount exceeded this, the specimen was evaluated as "bad". Table 4 shows the result. FIG. 6A shows the relationship between the adhesion-resistance values and the wear amounts after the single-body wear test for Examples 1-1 to 1-5, Comparative Example 1-2 and Comparative Example 1-3.

<Wear Test in Actual Machine>

Figure 6B:
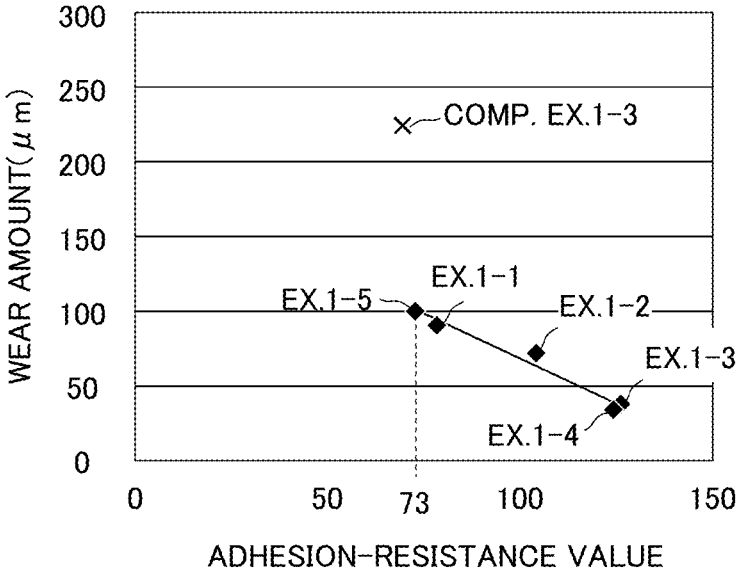
FIG. 6B is a graph showing the relationship between the adhesion-resistance values and the wear amounts after the wear test using actual machine for Examples 1-1 to 1-5 and Comparative Example 1-3.

Wear test was conducted using an actual machine to the specimens of the engine valves of Examples 1-1 to 1-5 and Comparative Examples 1-1 and 1-3. In this test, alcohol-containing fuel was used to check the attackability and the wear resistance of the cladding portion of the engine valve under the high-corrosive and strong reduction environment unlike the single-body wear test. Specifically this wear test in the actual machine was conducted for 300 hours using the gasoline engine of 2400 cc and the alcohol-containing fuel. After the wear test in the actual machine, the wear amount of the cladding portion of each engine valve and the wear amount of the valve seat were measured, and the sum of these amounts was calculated as the total wear amount. When the specimen had the wear amount that was 100 μm or less, it was evaluated as "good". When the wear amount exceeded this, the specimen was evaluated as "bad". FIG. 6B shows the relationship between the adhesion-resistance values and the wear amounts after the wear test in actual machine for Examples 1-1 to 1-5 and Comparative Examples 1-1 and 1-3.

TABLE 3

| | Chemical components of cladding alloy powder (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 1-1 | 22 | 12 | 2.0 | 1.00 | 6.0 | 0.8 | 5.0 | ≤0.4 | 0.3 | Remainder | 34 | 78 |
| Ex. 1-2 | 22 | 12 | 3.2 | 1.00 | 6.0 | 0.8 | 5.0 | ≤0.4 | 0.3 | Remainder | 34 | 105 |
| Ex. 1-3 | 22 | 12 | 4.2 | 1.00 | 6.0 | 0.8 | 5.0 | ≤0.4 | 0.3 | Remainder | 34 | 128 |
| Ex. 1-4 | 24 | 20 | 3.2 | 0.45 | 6.0 | 0.8 | 5.0 | ≤0.4 | 0.3 | Remainder | 68 | 126 |
| Ex. 1-5 | 22 | 10 | 2.0 | 1.30 | 6.0 | 0.8 | 5.0 | ≤0.4 | 0.3 | Remainder | 24 | 73 |
| Comp. Ex. 1-1 | 21 | 10 | 2.0 | 1.30 | 6.0 | 0.8 | 5.0 | ≤0.4 | 0.3 | Remainder | 23 | 73 |
| Comp. Ex. 1-2 | 22 | 12 | 1.5 | 1.00 | 6.0 | 0.8 | 5.0 | ≤0.4 | 0.3 | Remainder | 34 | 67 |
| Comp. Ex. 1-3 | 25 | 9 | 2.0 | 1.30 | 6.0 | 0.8 | 5.0 | ≤0.4 | 0.3 | Remainder | 24 | 70 |

TABLE 4

| | | Single-body wear test | | | | Wear test in actual machine | | | |
|---|---|---|---|---|---|---|---|---|---|
| | Corrosion test | Cladding portion [μm] | Valve seat [μm] | Total [μm] | Evaluation | Cladding portion [μm] | Valve seat [μm] | Total [μm] | Evaluation |
| Ex. 1-1 | Good | 13 | 85 | 98 | Good | 11 | 78 | 89 | Good |
| Ex. 1-2 | Good | 8 | 65 | 73 | Good | 8 | 61 | 69 | Good |
| Ex. 1-3 | Good | 5 | 37 | 40 | Good | 3 | 30 | 33 | Good |
| Ex. 1-4 | Good | 3 | 33 | 36 | Good | 4 | 27 | 31 | Good |
| Ex. 1-5 | Good | 15 | 85 | 100 | Good | 20 | 78 | 98 | Good |
| Comp. Ex. 1-1 | Bad | | | | | 13 | 250 | 263 | Bad |
| Comp. Ex. 1-2 | Good | 49 | 198 | 247 | Bad | | | | |
| Comp. Ex. 1-3 | Good | 40 | 188 | 228 | Bad | 54 | 172 | 226 | Bad |

(Result 3)

3-1. Appropriate Range of Corrosion-Resistance Value

Example 1-5 had the corrosion-resistance value of 24, and no corrosion was found at the cladding portion of Example 1-5 as shown in FIG. 5A. Comparative Example 1-1 had the corrosion-resistance value of 23, and corrosion was found at the cladding portion of Comparative Example 1-1 and the rough surface was observed as shown in FIG. 5B. Presumably in Comparative Example 1-1, the Co matrix corroded (galvanic-corroded) due to the carbide phase at the cladding portion, so that the carbide phase raised from the surface of the cladding portion, and so made the surface of the cladding portion coarse. As a result, Comparative Example 1-1 had a larger wear amount due to abrasive wear than Example 1-5 in this test using actual machine. To suppress such abrasive wear due to corrosion, it is necessary to satisfy the following Expression (1). Note here that Examples 1-1 to 1-4 also satisfied the following Expression (1) as shown in Table 3 and Table 4 and their result of wear test was good.

$$Cr(-0.53C+1.2)+Mo(-1.2C+2.8)\geq 24 \quad (1).$$

The chemical symbols shown in this Expression (1) represent the amounts of the corresponding elements in the mass %.

3-2. Appropriate Range of Adhesion Resistance

As shown in Table 3, Comparative Examples 1-2 and 1-3 had the corrosion-resistance values calculated by Expression (1A) of 24 or more. As shown in Table 4, the specimens of Comparative Examples 1-2 and 1-3 therefore had a good result of the corrosion test.

As shown in Table 3, however, the specimens of Comparative Examples 1-2 and 1-3 had the adhesion-resistance value of 67 and 70, respectively (specifically less than 73), so that the valve seats of Comparative Examples 1-2 and 1-3 generated adhesion and wear in the single-body wear test, and the wear amounts of Comparative Examples 1-2 and 1-3 were more than those of Examples 1-1 to 1-5.

Presumably this is because Comparative Example 1-2 lacked the amount of W included in the cladding powder, and so the base of the Cr oxide coating did have enough hardness, and the Cr oxide film therefore easily broke as compared with Examples 1-1 to 1-5. Presumably for Comparative Example 1-3, the specimen lacked the amount of Mo included in cladding powder, and so regeneration of the broken Cr oxide film was not promoted well. In this way, the result of the adhesion-resistance values of Examples 1-1 to 1-5 shows that it is necessary to satisfy the following Expression (2) in order to suppress adhesion and wear.

$$23W+2.7Mo\geq 73 \quad (2).$$

The chemical symbols shown in this Expression (2) represent the amounts of the corresponding elements in the mass %.

Based on the appropriate corrosion-resistance values and adhesion-resistance values as stated above, appropriate amounts of the chemical components of the cladding alloy powder were confirmed as follows.

4. Appropriate Range of the Amount of Cr

Examples 2-1 and 2-2

Similarly to Example 1-1, specimens including the cladding portions made of cladding alloy powder were prepared. These Examples 2-1 and 2-2 were different from Example 1-1 in the chemical components of the cladding alloy powder shown in Table 5. Table 5 shows the corrosion-resistance values and the adhesion-resistance values of Examples 2-1 and 2-2 that were calculated similarly to Example 1-1.

Comparative Examples 2-1 to 2-3

Similarly to Example 2-1, specimens including the cladding portions made of cladding alloy powder were prepared. These Comparative Example 2-1 to 2-3 were different from Example 2-1 in the chemical components of the cladding alloy powder shown in Table 5. Table 5 shows the corrosion-resistance values and the adhesion-resistance values of Comparative Example 2-1 to 2-3 that were calculated similarly to Example 2-1.

Similarly to Example 1-1, beads and cracking of these specimens were evaluated, and wear test and wear test in actual machine were conducted. Table 6 shows the result. Comparative Example 2-3 had a defective shape of the bead at the cladding portion, and had cracking at the cladding portion. Therefore wear test and wear test in actual machine were not conducted for Comparative Example 2-3.

TABLE 5

| | Chemical components of cladding alloy powder (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 2-1 | 22 | 12 | 3.2 | 1.00 | 6.0 | 0.8 | 5.0 | ≤0.4 | 0.3 | Remainder | 34 | 105 |
| Ex. 2-2 | 27 | 17 | 5.1 | 0.95 | 5.1 | 3.0 | 4.2 | ≤0.4 | <0.1 | Remainder | 47 | 164 |
| Comp. Ex. 2-1 | 21 | 12 | 3.0 | 1.00 | 6.0 | 0.8 | 5.0 | ≤0.4 | 0.3 | Remainder | 33 | 101 |
| Comp. Ex.-2 | 17 | 17 | 3.3 | 0.44 | 5.2 | 1.7 | 2.1 | ≤0.4 | 2.0 | Remainder | 55 | 122 |
| Comp. Ex. 2-3 | 29 | 17 | 5.1 | 0.95 | 5.1 | 4.2 | 4.2 | ≤0.4 | <0.1 | Remainder | 48 | 164 |

TABLE 6

| | | | | Wear test in actual machine | | | |
|---|---|---|---|---|---|---|---|
| | Bead shape | Cracked | Corrosion test | Cladding portion [μm] | Valve seat [μm] | Total [μm] | Evaluation |
| Ex. 2-1 | Good | No | Good | 8 | 61 | 69 | Good |
| Ex. 2-2 | Good | No | Good | | | | |
| Comp. Ex. 2-1 | Good | No | Bad | 15 | 220 | 235 | Bad |
| Comp. Ex. 2-2 | Good | No | Bad | 20 | 266 | 286 | Bad |
| Comp. Ex. 2-3 | Bad | Yes | | | | | |

(Result 4)

Examples 2-1 and 2-2 had the corrosion-resistance values exceeding 24 (see Table 5) and satisfied Expression (1) as stated above, and Examples 2-1 and 2-2 had good results of wear test (see Table 6). On the contrary, Comparative Examples 2-1 and 2-2 had the corrosion-resistance values exceeding 24 (see Table 5) and satisfied Expression (1), but Comparative Examples 2-1 and 2-2 had bad results of wear test (see Table 6). As a result, Comparative Examples 2-1 and 2-2 had the wear amounts more than that of Example 2-1 in the wear test using actual machine. These results show that presumably the specimens of Comparative Examples 2-1 and 2-2 did not have a sufficiently formed Cr oxide film as compared with Example 2-1, and the amount of Cr to form a Cr oxide film was not enough. Based on the above, it can be considered that the optimum amount of Cr in cladding alloy powder is 22 mass % or more.

Although Comparative Example 2-3 satisfied Expressions (1) and (2), they had a defective shape of the beads at the cladding portions as stated above, and cracking occurred at the cladding portions. Presumably this is because it included Cr too much, and the toughness of the cladding portion deteriorated. Based on this point and the result of Example 2-2, for example, it can be considered that the optimum amount of Cr in cladding alloy powder is 27 mass % or less.

5. Appropriate Range of the Amount of Mo

Examples 3-1 and 3-2

Similarly to Example 1-1, specimens including the cladding portions made of cladding alloy powder were prepared. These Examples 3-1 and 3-2 were different from Example 1-1 in the chemical components of the cladding alloy powder shown in Table 7. Table 7 shows the corrosion-resistance values and the adhesion-resistance values of Examples 3-1 and 3-2 that were calculated similarly to Example 1-1.

Comparative Examples 3-1 and 3-2

Similarly to Example 3-1, specimens including the cladding portions made of cladding alloy powder were prepared. These Comparative Example 3-1 and 3-2 were different from Example 3-1 in the chemical components of the cladding alloy powder shown in Table 7. Table 7 shows the corrosion-resistance values and the adhesion-resistance values of Comparative Example 3-1 and 3-2 that were calculated similarly to Example 3-1.

Similarly to Example 1-1, beads and cracking of these specimens were evaluated, and wear test was conducted. Table 8 shows the result. Comparative Example 3-2 had a defective shape of the bead at the cladding portion, and had cracking at the cladding portion. Therefore wear test was not conducted for Comparative Example 3-2. The shape of the bead at the cladding portion of Example 3-2 was not favorable as compared with the shapes of Example 3-1 and Comparative Example 3-1.

TABLE 7

| | Chemical components of cladding alloy powder (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 3-1 | 22 | 10 | 3.2 | 1.30 | 6.0 | 0.8 | 5.0 | ≤0.4 | 0.3 | Remainder | 24 | 101 |
| Ex. 3-2 | 27 | 30 | 5.1 | 1.30 | 6.0 | 0.8 | 5.0 | ≤0.4 | 0.3 | Remainder | 51 | 198 |
| Comp. Ex. 3-1 | 22 | 9 | 3.2 | 1.30 | 6.0 | 0.8 | 5.0 | ≤0.4 | 0.3 | Remainder | 22 | 98 |
| Comp. Ex.-2 | 27 | 32 | 5.1 | 1.30 | 6.0 | 0.8 | 5.0 | ≤0.4 | 0.3 | Remainder | 53 | 204 |

TABLE 8

| | Bead shape | Cracked | Corrosion test |
|---|---|---|---|
| Ex. 3-1 | Good | No | Good |
| Ex. 3-2 | Good | No | Good |
| Comp. Ex. 3-1 | Good | No | Bad |
| Comp. Ex.-2 | Bad | Yes | |

(Result 5)

Comparative Example 3-1 had the corrosion-resistance value of 22 (see Table 7) and did not satisfy Expression (1), and the result of wear test was bad (see Table 8). Comparative Example 3-1 had the amount of Cr within the optimum range as stated above, and the amount of Mo that was less than that of Example 3-1. Presumably based on this, the Cr oxide film at the cladding portion of Comparative Example 3-1 was not sufficiently formed due to the amount of Mo contained. Based on the above, it can be considered that the optimum amount of Mo in cladding alloy powder is 10 mass % or more.

Although Comparative Example 3-2 satisfied Expressions (1) and (2), they had a defective shape of the beads at the cladding portions as stated above, and cracking occurred at the cladding portions. Presumably this is because it included Mo too much, and the toughness of the cladding portion deteriorated. Based on this point and the result of Example 3-2, for example, it can be considered that the optimum amount of Mo in cladding alloy powder is 30 mass % or less.

6. Appropriate Range of the Amount of W

Examples 4-1 and 4-2

Similarly to Example 1-1, specimens including the cladding portions made of cladding alloy powder were prepared. These Examples 4-1 and 4-2 were different from Example 1-1 in the chemical components of the cladding alloy powder shown in Table 9. Table 9 shows the corrosion-resistance values and the adhesion-resistance values of Examples 4-1 and 4-2 that were calculated similarly to Example 1-1.

Comparative Examples 4-1 and 4-2

Similarly to Example 4-1, specimens including the cladding portions made of cladding alloy powder were prepared. These Comparative Examples 4-1 and 4-2 were different from Example 4-1 in the chemical components of the cladding alloy powder shown in Table 9. Table 9 shows the corrosion-resistance values and the adhesion-resistance values of Comparative Example 4-1 and 4-2 that were calculated similarly to Example 4-1.

Similarly to Example 1-1, beads and cracking of these specimens were evaluated, and wear test and single-body wear test were conducted. Table 10 shows the result. Comparative Example 4-2 had a defective shape of the bead at the cladding portion, and had cracking at the cladding portion. Therefore wear test and single-body wear test were not conducted for Comparative Example 4-2. The shape of the bead at the cladding portion of Example 4-2 was not favorable as compared with the shapes of Example 4-1 and Comparative Example 4-1.

TABLE 9

| | Chemical components of cladding alloy powder (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 4-1 | 22 | 12 | 2.0 | 1.00 | 6.0 | 0.8 | 5.0 | ≤0.4 | 0.3 | Remainder | 34 | 78 |
| Ex. 4-2 | 27 | 30 | 6.0 | 1.30 | 6.0 | 3.0 | 5.0 | ≤0.4 | 0.3 | Remainder | 51 | 219 |
| Comp. Ex. 4-1 | 22 | 12 | 1.5 | 1.00 | 6.0 | 0.8 | 5.0 | ≤0.4 | 0.3 | Remainder | 34 | 67 |
| Comp. Ex. 4-2 | 27 | 30 | 6.5 | 1.30 | 6.0 | 3.0 | 5.0 | ≤0.4 | 0.3 | Remainder | 51 | 231 |

TABLE 10

| | | | | Single-body wear test | | | |
|---|---|---|---|---|---|---|---|
| | Bead shape | Cracked | Corrosion test | Cladding portion [μm] | Valve seat [μm] | Total [μm] | Evaluation |
| Ex. 4-1 | Good | No | Good | 13 | 85 | 98 | Good |
| Ex. 4-2 | Good | No | Good | 2 | 19 | 21 | Good |
| Comp. Ex. 4-1 | Good | No | Good | 49 | 198 | 247 | Bad |
| Comp. Ex. 4-2 | Bad | Yes | | | | | |

(Result 6)

Examples 4-1 and 4-2 and Comparative Example 4-1 had the corrosion-resistance values exceeding 24 (see Table 9)

and satisfied Expression (1) as stated above, and Examples 4-1 and 4-2 and Comparative Example 4-1 had good results of wear test (see Table 10). On the contrary, Comparative Example 4-1 had the adhesion-resistance value of 67 (see Table 9) and did not satisfy Expression (2), and the result of single-body wear test was bad (see Table 10). Comparative Example 4-1 had the amounts of Cr and Mo within the optimum ranges as stated above, and the amount of W that was less than that of Example 4-1. Presumably this suppressed the generation of tungsten carbide making up a hard carbide phase in the cladding portion of Comparative Example 4-1, and so the hardness of the cladding portion deteriorated. Therefore the Cr oxide film broke due to the surface pressure of the valve seat, and adhesion and wear of the valve seat were advanced. Based on the above, it can be considered that the optimum amount of W in cladding alloy powder is 2.0 mass % or more.

Although Comparative Example 4-2 satisfied Expressions (1) and (2), they had a defective shape of the beads at the cladding portions as stated above, and cracking occurred at the cladding portions. Presumably this is because it included W too much, and the toughness of the cladding portion deteriorated. Based on this point and the result of Example 4-2, for example, it can be considered that the optimum amount of W in cladding alloy powder is 6.0 mass % or less.

7. Appropriate Range of the Amount of C

Example 5-1 and 5-2

Similarly to Example 1-1, specimens including the cladding portions made of cladding alloy powder were prepared. These Examples 5-1 and 5-2 were different from Example 1-1 in the chemical components of the cladding alloy powder shown in Table 11. Table 12 shows the corrosion-resistance values and the adhesion-resistance values of Examples 5-1 and 5-2 that were calculated similarly to Example 1-1.

Comparative Examples 5-1 to 5-3

Similarly to Example 5-1, specimens including the cladding portions made of cladding alloy powder were prepared. These Comparative Example 5-1 to 5-3 were different from Example 5-1 in the chemical components of the cladding alloy powder shown in Table 11. Table 12 shows the corrosion-resistance values and the adhesion-resistance values of Comparative Example 5-1 to 5-3 that were calculated similarly to Example 5-1.

Similarly to Example 1-1, beads and cracking of these specimens were evaluated, and wear test, single-body wear test and wear test in the actual machine were conducted. Table 12 shows the result. All of the specimens showed favorable quality of the cladding portion, and no defectives were found for the shapes of their beads at the cladding portion, and no cracking was found at their cladding portions. Single-body wear test was not conducted for the specimen of Comparative Example 5-3 and wear test in the actual machine was not conducted for the specimens of Example 5-1 and Comparative Example 5-1.

TABLE 11

| | Chemical components of cladding alloy powder (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 5-1 | 22 | 12 | 3.2 | 0.40 | 6.0 | 0.8 | 5.0 | ≤0.4 | 0.3 | Remainder | 50 | 105 |
| Ex. 5-2 | 22 | 10 | 2.0 | 1.30 | 6.0 | 0.8 | 5.0 | ≤0.4 | 0.3 | Remainder | 24 | 73 |
| Comp. Ex. 5-1 | 22 | 12 | 3.2 | 0.25 | 6.0 | 0.8 | 5.0 | ≤0.4 | 0.3 | Remainder | 53 | 105 |
| Comp. Ex. 5-2 | 21 | 12 | 3.2 | 0.01 | 6.0 | 0.8 | 5.0 | ≤0.4 | 0.3 | Remainder | 59 | 105 |
| Comp. Ex. 5-3 | 22 | 10 | 2.0 | 1.50 | 6.0 | 0.8 | 5.0 | ≤0.4 | 0.3 | Remainder | 19 | 73 |

TABLE 12

| | | Single-body wear test | | | | Wear test in actual machine | | | |
|---|---|---|---|---|---|---|---|---|---|
| | Corrosion test | Cladding portion [μm] | Valve seat [μm] | Total [μm] | Evaluation | Cladding portion [μm] | Valve seat [μm] | Total [μm] | Evaluation |
| Ex. 5-1 | Good | 11 | 61 | 72 | Good | | | | |
| Ex. 5-2 | Good | 15 | 85 | 100 | Good | 20 | 78 | 98 | Good |
| Comp. Ex. 5-1 | Good | 65 | 65 | 130 | Bad | | | | |
| Comp. Ex. 5-2 | Good | 81 | 57 | 138 | Bad | 80 | 120 | 200 | Bad |
| Comp. Ex. 5-3 | Bad | | | | | 11 | 263 | 274 | Bad |

(Result 7)

Examples 5-1 and 5-2 and Comparative Examples 5-1 and 5-2 had the corrosion-resistance values exceeding 24 (see Table 11) and satisfied Expression (1) as stated above, and Examples 5-1 and 5-2 and Comparative Examples 5-1 and 5-2 had good results of wear test (see Table 12). On the contrary, Comparative Examples 5-1 and 5-2 had the adhesion-resistance value of 73 or more (see Table 11) and so satisfied Expression (2). The wear amounts of Comparative Examples 5-1 and 5-2 in the single-body test, however, were more than those of Examples 5-1 and 5-2, and the wear amount of Comparative Example 5-2 in the test using the actual machine was more than that of Example 5-2. Presumably this is because the amounts of C in Comparative Examples 5-1 and 5-2 were less than those of Example 5-1 and 5-2. Presumably this suppressed the generation of a hard carbide phase in the cladding portion of Comparative Examples 5-1 and 5-2 as compared with Example 5-1 and 5-2, and so their Cr oxide film broke. The valve seat abutting against the cladding portion therefore adhered to the Co matrix of the cladding portion, and this accelerated the wear. Based on the above, it can be considered that the optimum amount of C in cladding alloy powder is 0.40 mass % or more.

Comparative Example 5-3 had the corrosion-resistance value of 19 (see Table 11) and did not satisfy Expression (1), and the result of wear test was bad (see Table 12). Comparative Example 5-3 had the amounts of Cr, Mo and W within the optimum ranges as stated above, and the amount of C that was more than that of Example 5-2. Presumably this caused excessive generation of carbide in the Co matrix of the cladding portion of Comparative Example 5-3, and so the Cr oxide film was not formed sufficiently. As a result, the corrosion resistance of the cladding portion deteriorated. Based on this point and the result of Example 5-2, for example, it can be considered that the optimum amount of C in cladding alloy powder is 1.30 mass % or less.

8. Appropriate Range of the Amount of Si

Examples 6-1 and 6-2

Similarly to Example 1-1, specimens including the cladding portions made of cladding alloy powder were prepared. These Examples 6-1 and 6-2 were different from Example 1-1 in the chemical components of the cladding alloy powder shown in Table 13. Table 13 shows the corrosion-resistance values and the adhesion-resistance values of Examples 6-1 and 6-2 that were calculated similarly to Example 1-1.

Comparative Example 6-1

Similarly to Example 6-1, a specimen including the cladding portion made of cladding alloy powder was prepared. This Example 6-1 was different from Example 1-1 in the chemical components of the cladding alloy powder shown in Table 13. Table 13 shows the corrosion-resistance value and the adhesion-resistance value of Comparative Example 6-1 that were calculated similarly to Example 1-1.

Similarly to Example 1-1, beads and cracking of the specimen were evaluated, and wear test was conducted. Table 14 shows the result. Comparative Example 6-1 had a defective shape of the bead at the cladding portion, and had cracking at the cladding portion. Therefore wear test was not conducted for Comparative Example 6-1.

TABLE 13

| | Chemical components (mass %) | | | | | | | | | | Corrosion resistance | Adhesion-resistance |
|---|---|---|---|---|---|---|---|---|---|---|---|---|
| | Cr | Mo | W | C | Ni | Si | Fe | S | Mn | Co | value | value |
| Ex. 6-1 | 27 | 22 | 4.2 | 1.00 | 6.0 | 0.8 | 5.0 | ≤0.4 | 0.3 | Remainder | 53 | 156 |
| Ex. 6-2 | 27 | 17 | 5.1 | 0.95 | 5.1 | 3.0 | 4.2 | ≤0.4 | <0.1 | Remainder | 47 | 164 |
| Comp. Ex. 6-1 | 27 | 17 | 5.1 | 0.95 | 5.1 | 4.2 | 4.2 | ≤0.4 | <0.1 | Remainder | 47 | 164 |

TABLE 14

| | Bead shape | Cracked | Corrosion test |
|---|---|---|---|
| Ex. 6-1 | Good | No | Good |
| Ex. 6-2 | Good | No | Good |
| Comp. Ex. 6-1 | Bad | Yes | |

(Result 8)

Although the cladding powder used for these specimens satisfied Expressions (1) and (2), Comparative Example 6-1 had a defective shape of the bead at the cladding portion as stated above, and cracking occurred at the cladding portion. Based on the above, it can be considered that the optimum amount of Si in cladding alloy powder is 3.0 mass % or less.

That is a detailed description of one embodiment of the present disclosure. The present disclosure is not limited to the above-stated embodiment, and the design may be modified variously without departing from the spirits of the present disclosure defined in the attached claims.

DESCRIPTION OF SYMBOLS

1 Engine valve
10 Valve body
20 Cladding portion
30 Valve seat

What is claimed is:

1. Cladding alloy powder to form a cladding portion at an engine valve that comes in contact with a valve seat of an engine, consisting of:

22 to 27 mass % of Cr; 10 to 30 mass % of Mo; 2.0 to 6.0 mass % of W; 0.40 to 1.30 mass % of C; 3.0 mass % or less of Si; 15.0 mass % or less of Ni; 30.0 mass % or less of Fe; and 0.4 mass % or less of S; 3.0 mass % or less of Mn; as well as Co as a remainder, and the cladding alloy powder satisfies the following Expressions (1) and (2):

$$Cr(-0.53C+1.2)+Mo(-1.2C+2.8)\geq 24 \quad (1); \text{ and}$$

$$23W+2.7Mo\geq 73 \quad (2),$$

where chemical symbols shown in the Expressions (1) and (2) represent amounts of the corresponding elements in the mass %.

2. An assembly comprising an engine valve including the cladding alloy powder according to claim 1 deposited at a part to come in contact with the valve seat in combination with the valve seat.

* * * * *